US011054099B2

(12) United States Patent
Lanz

(10) Patent No.: US 11,054,099 B2
(45) Date of Patent: Jul. 6, 2021

(54) HIGH POWER LED FLOODLIGHT LAMPS AND FLOODLIGHT SYSTEMS USING SAID FLOODLIGHT LAMPS TO ILLUMINATE SPORTS FIELDS

(71) Applicant: Rüdiger Lanz, Simmertal (DE)

(72) Inventor: Rüdiger Lanz, Simmertal (DE)

( * ) Notice: Subject to any disclaimer, the term of this patent is extended or adjusted under 35 U.S.C. 154(b) by 0 days.

(21) Appl. No.: 16/486,630

(22) PCT Filed: Feb. 16, 2018

(86) PCT No.: PCT/DE2018/100142
§ 371 (c)(1),
(2) Date: Sep. 19, 2019

(87) PCT Pub. No.: WO2018/149457
PCT Pub. Date: Aug. 23, 2018

(65) Prior Publication Data

US 2020/0049319 A1 Feb. 13, 2020

(30) Foreign Application Priority Data

Feb. 16, 2017 (DE) ..... 10 2017 103 256.8

(51) Int. Cl.
*F21S 8/08* (2006.01)
*F21V 29/77* (2015.01)
(Continued)

(52) U.S. Cl.
CPC ..... *F21S 8/085* (2013.01); *F21V 7/0066* (2013.01); *F21V 21/28* (2013.01); *F21V 21/30* (2013.01);
(Continued)

(58) Field of Classification Search
CPC ..... F21S 8/085; F21V 29/773; F21V 7/0066; F21V 21/28; F21V 21/30; F21Y 2115/10; F21W 2131/105
(Continued)

(56) References Cited

U.S. PATENT DOCUMENTS

RE26,588 E * 5/1969 Neely ..... F21S 2/00 362/234
8,789,967 B2 * 7/2014 Gordin ..... F21S 4/00 362/223
(Continued)

FOREIGN PATENT DOCUMENTS

DE 102011113653 A1 3/2013
KR 200466394 Y1 4/2013
(Continued)

OTHER PUBLICATIONS

International Search Report from corresponding International Application No. PCT/DE2018/100142, dated Apr. 26, 2018, pp. 1-6, European Patent Office, Rijswijk, Netherlands.

*Primary Examiner* — Rajarshi Chakraborty
*Assistant Examiner* — Hana S Featherly
(74) *Attorney, Agent, or Firm* — Hauptman Ham, LLP

(57) ABSTRACT

The invention relates to high power LED floodlight lamps (1) for arrangement on floodlight towers (2) on the lateral edges of a sports field for illumination thereof, wherein each LED floodlight lamp (1) comprises 4 LED emitters (14), which are formed at least from a housing (6), a cooling element (5), a reflector lens and a high power LED chip, wherein the LED emitters (14) are arranged in pairs on a carrier frame having joint connections, wherein an upper LED emitter pair (15) sits on a common carrier element (4), aligned parallel, and has a reflector lens, which effects a narrow emission angle, whereby the light emission of said LED emitter pair (15) is amplified, equally aligned, and thus
(Continued)

Figure 1:
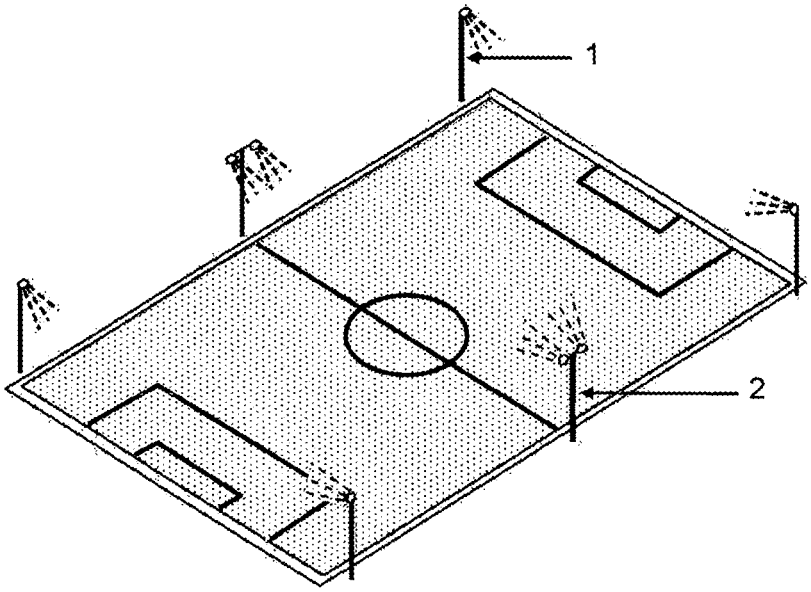

overcomes additional sections in order to reach the center region of the sports field, whereas a lower LED emitter pair (16) sits on a separately alignable carrier element (4') and has reflector lenses which effect a wide emission angle, whereby the light emission of said LED emitter pair (16) is alignable separate from each other for targeted illumination of the edge regions of the sports field located closer to the floodlight tower.

9 Claims, 3 Drawing Sheets

(51) Int. Cl.

| | |
|---|---|
| ***F21V 7/00*** | (2006.01) |
| ***F21V 21/28*** | (2006.01) |
| ***F21V 21/30*** | (2006.01) |
| *F21Y 115/10* | (2016.01) |
| *F21W 131/105* | (2006.01) |

(52) U.S. Cl.
CPC ..... *F21V 29/773* (2015.01); *F21W 2131/105* (2013.01); *F21Y 2115/10* (2016.08)

(58) Field of Classification Search
USPC ..... 362/245, 249.01
See application file for complete search history.

(56) References Cited

U.S. PATENT DOCUMENTS

| | | | |
|---|---|---|---|
| 2006/0245189 | A1 | 11/2006 | Gordin |
| 2012/0307486 | A1 | 12/2012 | Gordin et al. |
| 2015/0308655 | A1 | 10/2015 | Holmes et al. |

FOREIGN PATENT DOCUMENTS

| | | | |
|---|---|---|---|
| WO | 2006125792 | A1 | 11/2006 |
| WO | 2016068285 | A1 | 5/2016 |

* cited by examiner

HIGH POWER LED FLOODLIGHT LAMPS AND FLOODLIGHT SYSTEMS USING SAID FLOODLIGHT LAMPS TO ILLUMINATE SPORTS FIELDS

The present application relates to high-power LED floodlight lamps as well as to floodlight systems using them.

For the continuous holding of sporting competitions as well as for training purposes including in the evening and during the low-light winter months, it is necessary to provide sports field facilities with appropriate illumination systems, which are generally called floodlight systems. Lighting requirements for such systems are found in the industry standard DIN EN 12193 "Light and illumination, sports facilities illumination". It is relevant here that there are many different requirements for these sports illumination systems, depending on the particular use and the level of competition being played at, for example.

Different illumination classes are therefore distinguished depending on the requirements in illumination class I for high-power training (international and national competitions), illumination class II for competitions at intermediate level (regional and local competitions as well as training) and illumination class III for general training and recreational sport. It is illumination class III which is most frequently realized in terms of numbers, since this involves illumination systems as can be found very widespread at many regional sporting facilities. In terms of numbers, it is an order of magnitude of sports field illumination facilities which are constructed and operated at the highest requirement level, such as for stadiums of the national soccer league.

In particular, the reporting of sporting events by television broadcasting brings about entirely different requirements for the sports facilities illumination than are required by everyday operation in terms of safe training sessions or smaller regional competitions, which generally do not require any media broadcasting.

These different requirements find direct expression in the requirements necessary for the sports field illumination systems. These requirements are also the subject matter of the licensing procedures of soccer associations, such as the German Soccer Association (DFB), which sets minimum light intensities for floodlight systems.

The German Soccer League (DFL) also here sets license requirements in regard to floodlight systems for stadiums of the 1st and 2nd German national league. Here, a minimum illumination intensity is defined at a height of 1.5 m above the playing field. The corresponding parameters for the required minimum illumination intensities have been changing toward stronger illumination intensities in recent years, since high light levels are needed precisely because of the increasing demands on the media broadcast being filmed, for example in regard to slow-motion playback. Illumination requirements for HDTV, for example, require a minimum illumination intensity of 2000 lux. Further instructions come for example from the European Football Association (UEFA) and the World Football Association (FIFA). Thus, specific instructions are set in regard to the minimum illumination intensity of matches in connection with UEFA, such as for example the Champions League or the Europa League.

The uniform lighting of such a soccer field, not situated for example in a stadium, is much more difficult, because it is generally the case here that 3 floodlight towers, for example, are distributed at uniform intervals on both long sides of the playing field, yet not situated in the corner of the playing field, but instead often situated offset from the corners by around 17 meters to the center, i.e., each time there is a distance of the side tower from the corner flag of around 17 meters. The 3rd side tower is then located precisely at the center of the field. This causes in particular the central problem that it is very hard to light the entire field uniformly in this way, since the corners of the playing field in particular can only be reached by lights with difficulty.

The standard practice today is to attach 8 lamps to these 6 floodlight towers, for example. This means one floodlight lamp on one floodlight tower in every corner, or at a distance of 17 meters from each corner, and 2 floodlight lamps each on the middle floodlight towers. In this way, 4 strong lamps shine onto the field from each flank of the soccer field in order to light it up. In many cases, the corners here are only sparingly illuminated.

Given this background, it is of exceptional importance to the operators of sporting facilities what operating costs are caused by the mandatorily prescribed floodlight systems. This involves primarily a reduction of the electricity consumption for the highest possible power, wherein long service life of the light sources and low maintenance intensity are sought.

Given this background, and in the course of the general development in the field of illumination, a clear trend can also be seen in the field of sports field illumination systems toward the use of LED illumination means, wherein thus far clear limits have been placed in regard to the required illumination intensity. Furthermore, it has been critical thus far that the required high light intensities could not be realized by LED engineering with significantly less power consumption, which made a switch to LED illumination economically unappealing.

Solutions offered thus far that are based on LED lighting engineering, besides the above mentioned defects, furthermore have a defect in regard to the full-area and uniform lighting of the sports field. In an arrangement for example on 6 floodlight towers arranged at the sides, the large-area arrangement of a plurality of LED luminants in these floodlight lamps produces a very broad emission with high power losses, so that the economic effectiveness of these solutions is also not given at present, because there is no desired savings of electricity costs.

An arrangement of LED lamps for outdoor use is disclosed from the document of US 2015/0308655 A1 which outdoor use is addressed particularly to be able to light event venues. This discloses, besides the actual construction of the lamps, also an arrangement on a supporting framework, wherein a plurality of individual lamp bodies is to be arranged on a supporting framework. It is also disclosed here that these lamps are arranged at an angle from a central beam axis toward the marginal region, as a result of which a large-area lighting of a sports venue, for example can be possible.

Basically, however, identical lamp bodies are mounted here in a large number on the supporting framework, for example there are 24 lamps in the exemplary representation of FIG. 1, which are arranged on a scaffold-like carrier. The scaffold carrying these lamps has in this case a static configuration in a plane of construction and the lamps are oriented by a pivotable bracket arranged at the rear side on the lamp. It is seen here that the primary intent is to achieve a large luminous output thanks to the mass of lamps. This is a very energy-intensive system, since the large number of lamps consumes corresponding wattage.

An LED high-power spot is disclosed from the laid-open patent application DE 10 2011 113 652 A1 which power spot is basically open to many applications. The disclosure pertains solely here to the basic design of this LED spot, wherein an application in the field of floodlight systems is not suggested in the laid-open patent application.

An LED high-power spot is disclosed from the laid-open patent application DE 10 2011 113 652 A1 which power spot is basically open to many applications. The disclosure pertains solely here to the basic design of this LED spot, wherein an application in the field of floodlight systems is not suggested.

Finally, a floodlight arrangement is disclosed from the publication US 2006/0245189 A1, disclosing an arrangement of emitters on floodlight towers. The idea of the disclosure of the invention in this document is a specific method of orienting these illumination means in a particular form. The background here is that in this way a plurality of concentrated LED beams should be detected in order to be optimally oriented, so that the number of emitters that are needed to accomplish a defined illumination function is to be minimized. Accordingly, the method disclosed here should, incorporated in computer-controlled calculation models by measuring at particular target points, improve and assist these project planning tasks. Accordingly, a concrete structural design of a floodlight system which can advantageously assure illumination of a sports field for example is not the goal of the disclosure here.

Therefore, a problem which one or more embodiments of the present invention proposes to solve is to create an improved floodlight system and on the basis of LED luminants, making possible the benefits of LED technology in regard to longer service life of the luminants as well as lower, but especially also effecting an improvement in regard to the uniformity in the illumination of a sports field.

This is accomplished by high-power LED floodlight lamps as claimed in the characterizing features of claim 1.

Advantageous embodiments of the high-power LED floodlight lamps according to the invention are described in dependent claims 2 to 7. Claims 8 and 9 relate to a floodlight system for the illumination of sports fields making use of the high-power LED floodlight lamps according to one or more embodiments of the invention.

At least one fundamental improvement approach compared to the floodlight systems used in the prior art in the field of illuminating smaller sports field facilities emerges from the fact that at least one concept according to an embodiment of the invention tries to compensate for the major drawback which requires an arrangement of floodlight illumination at only a few floodlight towers with low height near the edge of a playing field or a sports field.

The background here is that, at small sports facilities, for example in the area of soccer matches not held in modern stadiums, lesser requirements exist for the light quality for the sports field illumination, which however means in practice that the illumination is often defective in terms of the uniform lighting of the overall field. Generally, this is due to the arrangement of the emitters on the floodlight towers, wherein four lamps are generally arranged on the three respective side towers in the prior art, one each at the respective light towers associated with the corners and two on a crossbeam on the side floodlight tower arranged at the height of the center line. This gives a total of eight floodlight lamps, which are directed at the playing field such that it is irradiated with the fullest possible area.

Now, the concept according to an embodiment of the invention goes beyond this prior art, but at the same time it utilizes the existing design specifications in regard to the floodlight towers. That is, an attempt is made to illuminate the sports field more uniformly and completely despite the scant possibilities afforded by the six relatively low floodlight towers surrounding the sports field.

Therefore, LED floodlight lamps are arranged on the existing or newly constructed floodlight towers of similar form that are designed not as a single bright emitter in the sense of the prior art, but rather that consist of a combination of LED emitters illuminating the sports field with hinged LED emitters that are additionally directed in particular into the corners and at the outside lines of the playing field, so as to be able to achieve a required light intensity even in the region which is only poorly illuminated in the prior art. A corresponding exemplary diagram of the lighting is explained more closely below with a view to the illustrative representation.

The concept of the floodlight system according to an embodiment of the invention proposes here that the novel floodlight lamp comprises differently orientable LED emitters and can be arranged at the usual fastening points on the floodlight tower via a common supporting structure carrying the individual LED lamps. It is important here that these are LED emitters comprising a single high-power LED chip as the light source and not a plurality of single LEDs arranged next to each other in a planar manner, as is disclosed in the prior art, for example from US 2015/0308655 A1. These planar single LED arrangements used in the prior art likewise require plastic lenses or lens arrays arranged in a matlike mannner and associated with the respective single LED, or Fresnel lenses as is the case with US 2015/0308655 A1. This has the negative effect of color shifts in the marginal region toward the green region, having a negative impact on the light emitted.

The use of only one LED chip in each of the LED emitters in combination with a reflector lens likewise relevant to an embodiment of the invention brings about a higher luminous output and quality as well as an orientability of the light emission, representing a central element of an embodiment of the invention. The negative effect of the color shift is also absent, since no front-mounted plastic lenses are required, as this function of light focusing or scattering is performed respectively by a reflector surrounding the LED chip.

An additional positive benefit of this solution is that the single LED emitters forming the floodlight lamp can be very compact in design. The LED chips are significantly better protected in a stable housing with front-mounted reflector lens and a front disk mounted on the reflector and closing the emitter both in regard to mechanical damage, and also in regard to dirt and grime and effects of the weather, than is the case with known floodlight lamps having LED lamps. This, in turn, brings about a longer service life of the LED chips as lamps and thus a further improvement in the economic effectiveness of these floodlight lamps in relation to previous solutions, as well as to alternative LED floodlight lamps.

The combination of LED chip and reflector lens has a further central benefit, which is relevant precisely in the field of floodlight lamps. Since the floodlight illumination should make possible the usability of the sports field for the active athlete as well as the viewing of the public at the side of the sports field or in the stands, it is a central desire to minimize the glare from the floodlight lamps for both these groups. Here as well, the heretofore common planar arrangements of a plurality of LEDs with front-mounted plastic lenses are very disadvantageous, since the participants with a view looking at the floodlight lamps are blinded badly by looking directly at the LED lamps.

The arrangement according to an embodiment of the invention has the effect that the extremely bright LED chips in the LED emitter are arranged set back, and thus the front-mounted reflector lens reduces the direct viewing of the LED lamps. A targeted scattering or focusing depending on the orientation of the LED emitter is accomplished deliberately by the choice of a suitable reflector lens, wherein blinding of active participants as well as onlookers can be significantly reduced.

Now, the solution according to an embodiment of the invention is constructed such that each LED floodlight lamp comprises 4 LED emitters, which are formed as described at least from a housing, a cooling element, a reflector lens and a high-power LED chip, wherein the LED emitters are arranged in pairs on a carrier frame having joint connections. Thus, there is formed an upper LED emitter pair, which sits on a common carrier element, aligned in parallel, and is provided with a reflector lens which effects a narrow emission angle, whereby the light emission of this LED emitter pair is amplified in an equally aligned manner and thus overcomes further sections in order to reach the center region of the sports field. The arrangement above the second, lower LED emitter pair is deliberately chosen, since the lower pair is supposed to cover areas nearer the floodlight tower and could not shine freely if it were arranged above.

A lower LED emitter pair, in contrast with the statically and parallel aligned upper pair, now sits respectively on a separately alignable carrier element and is provided with reflector lenses which effect a wide emission angle, whereby the light emission of this LED emitter pair is alignable on the one hand separately from each other for targeted illumination of the regions near to the edge of the sports field located closer to the floodlight tower. On the other hand, the wider emission angle has the effect that these regions in the vicinity of the tower can be lit extensively at the relatively short distance.

In one advantageous design, the upper LED emitter pair thanks to the housings used having reflector lens has a narrow emission angle between around 7° and 25° for the long distance and the LED emitters forming the lower LED emitter pair have a wide emission angle for the short distance between around 40° and 60°. In this way, the mentioned illumination is possible in a targeted manner.

These aspects of the varying emission optics within a high-power LED floodlight lamp according to the invention are quite central in order to be able to accomplish the desired advantageous effects and constitute here a solution which thus does not exist in the prior art, since here generally either individual very bright emitters are used which still can not achieve a uniform field coverage with large light losses, or a large number of individual lamps are worked with which however are also supposed to accomplish merely an adding up in the area. The targeted integration of different emitters with precise orientation within a high-power LED floodlight lamp is thus not realized or suggested.

In one advantageous design in accordance with an embodiment, a crossbeam is arranged here on a roughly U-shaped base carrier, which is to be fastened to the floodlight tower, which crossbeam carries a paired arrangement of two LED emitter lamps which can only be changed in their emission angle relative to the sports field about a swivel axis. Below this arrangement there is at least one further hinged support, carrying for example the two further LED emitters, which can swivel independently of each other and independently of the LED emitters arranged in pairs in two joint planes, so that they can be oriented to any given point of the sports field.

This has the effect that, when the U-shaped carrier is arranged on a floodlight tower, on the one hand the two pivotably individually orientable LED emitters can be directed for example at the playing field corner and at an outside line of the sports field, and at the same time the emitters arranged in pairs can be directed almost as background illumination centrally on the playing field. In practice, when 16 of these floodlight lamps for example are arranged on the six side floodlight towers surrounding the sports field, this results in 64 individual LED emissions from the 64 LED emitters. In a paired orientation of 2 LED emitters and 2 further freely orientable LED emitters according to this design, there are 3 possible different emission angles for each of the installed LED floodlight lamps, so that 48 different light emissions can be output from the 16 floodlight lamps onto the sports field, and thus the sports field is completely and uniformly illuminated.

For a complete illumination in these conditions, a specific conceptual orientation of the lamps is provided, in order to be able to optimize the uniform distribution on the sports field by an advantageous overlapping of the light fields formed from the individual emissions. One alternative design of the floodlight system proposes here for specific carrier frame arrangements of the floodlight lamps to be predesigned such that the exact orientation to the sports field is achieved already without any later orienting of the individual lamps on the carrier frame. This is dictated by the parameters of the exact arrangement of the floodlight towers on the lateral sides of the sports field, the height of the arrangement of the floodlight lamps on the corresponding floodlight towers and the fundamental limitation or size of the sports field itself.

Since these parameters are often standardized for existing sports facility layouts, however especially in the case of newly designed sports facilities, can be provided in a preliminary design process coordinated with the floodlight system, it is provided according to an embodiment of the invention to predesign the specific angled portions of the single LED emitters of the floodlight lamps precisely so that the floodlight lamps with the differently oriented LED emitters therein can be fastened to the defined points of the floodlight towers with no further need for adjustment.

This produces a floodlight system according to the invention in which specifically designed floodlight lamps are arranged on the respective floodlight towers, whose single LED emitters are designed each time only for the specific tower and fastening point at which they are to be fastened. In this way, several differently predesigned carrier frames for these floodlight lamps are achieved in this floodlight system. This also results in pairwise identical carrier frames, for example, the oppositely facing floodlight towers arranged roughly at the height of the center line of the sports field or else the towers arranged diagonally opposite each other roughly at the corners of the playing field, in which identical carrier frame configurations can be used.

A significant advantage and thus also a compelling aspect for the economical application of LED illumination at sports facilities herein is that the floodlight system according to an embodiment of the invention minimizes the loss of light emission in the prior art, which either illuminates regions of the sports field which are already sufficiently lit, or which shine beyond the outer edges of the sports field to be illuminated. It also plays a role here that, according to an embodiment of the invention it is provided that the different LED emitters working together in a floodlight lamp, may also be designed differently in regard to both their luminous power and also in regard to their optics. Therefore, according to an embodiment of the invention, different reflectors are used in the LED emitters used together in a floodlight lamp.

In this way, for example, an LED emitter on the corner tower of the floodlight system shining downward relatively steeply into a corner of the sports field has a different light intensity and scattering properties than an LED emitter used in the same floodlight lamp and oriented centrally at the field. In this way, it is additionally possible to optimize the illumination of the sports field and at the same time to consume only the power consumption which is actually needed to achieve the standardized light intensity on the playing field thanks to the combination of the single LED emitters in the floodlight lamps. This is an important departure and improvement with respect to the widely scattering and thus not differentially emitting floodlight lamps which are currently used also in the field of LED floodlight designs.

The invention shall be explained more closely in the following with the aid of drawings. There are shown FIG. 1 an arrangement of floodlight lamps on floodlight towers, such as is widely used at present, FIG. 2 a high-power LED floodlight lamp 1 according to an embodiment of the invention in perspective front view on the carrier frame, FIG. 3 a high-power LED floodlight lamp 1 according to an embodiment of the invention in perspective rear view on the carrier frame, FIG. 4 a carrier frame of the high-power LED floodlight lamp 1 according to an embodiment of the invention without LED emitters in perspective rear view and FIG. 5 a radiation diagram for the illumination of a sports field with 6 side floodlight towers.

FIG. 1 makes it clear how at the present day the vast majority of sports facilities are fitted with floodlight systems. On the long edges of the sports field there are respectively set up 3 floodlight towers 2, at the upper end of which the floodlight lamps are mounted. In the traditional lamps, one such floodlight lamp is mounted herein on the towers at each corner and 2 of them in the middle.

Figure 2:
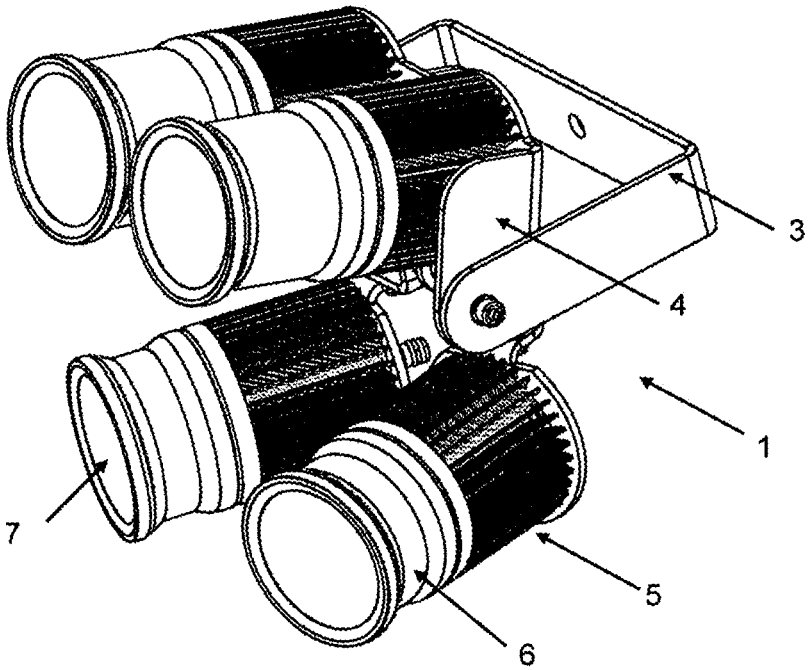
Figure 3:
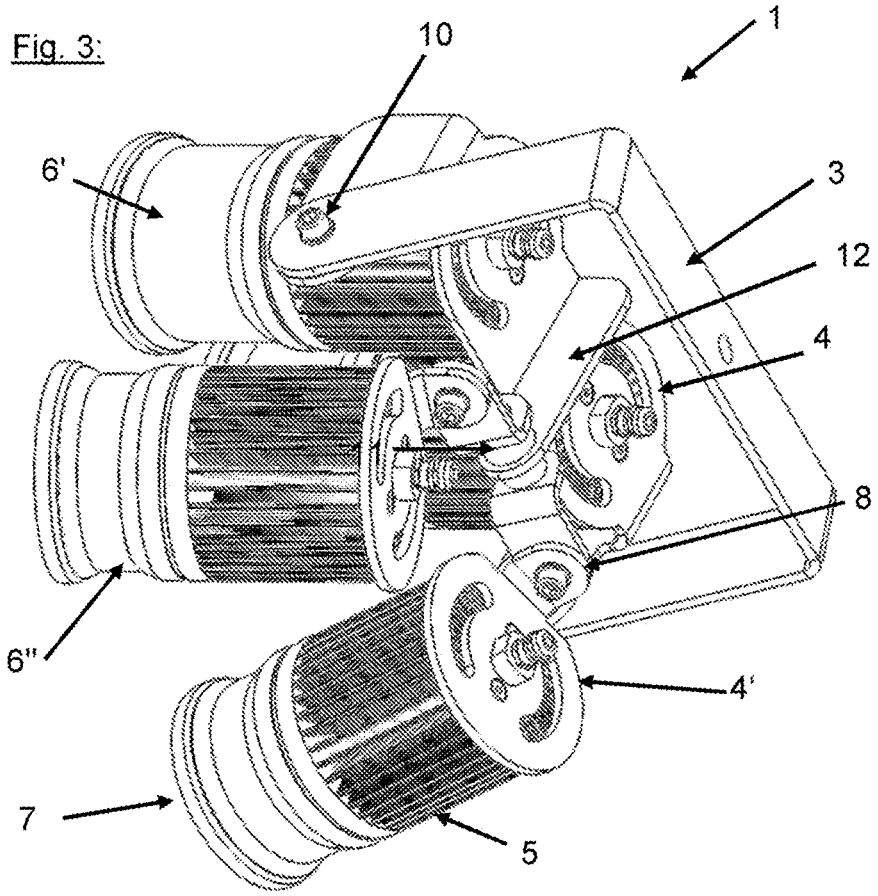
Figure 4:
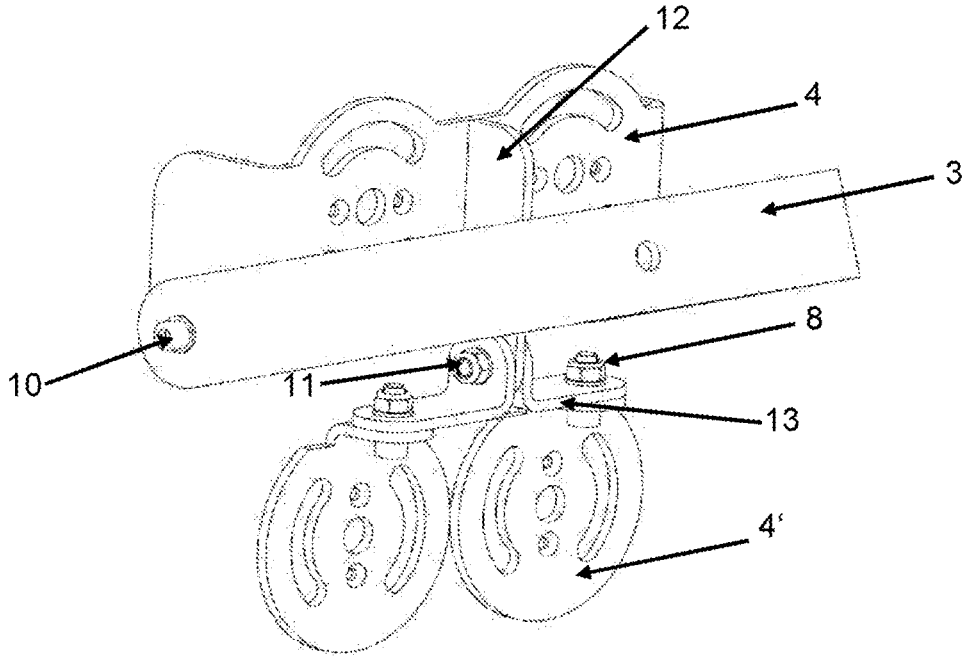

The further FIGS. 2 to 4 relate to the high-power LED floodlight lamp 1 according to an embodiment of the invention and to the carrier frame newly developed for this.

FIGS. 2 and 3 also show here the mounted LED emitters, there being 4 LED emitters hinged to the carrier frame in this design. These LED emitters are formed from a rear-side cooling element 5, adjoined by a housing 6, in which the LED chip and the reflector lens placed in front of it are arranged (not shown). This structural unit is closed off by a front disk 7, so that the LED emitters can be designed entirely enclosed, but the heat dissipation from the LED chip is totally ensured by the cooling element directly adjacent to it on the rear side.

Now, these LED emitters are mounted according to a embodiment of the invention on carrier elements 4 and 4', the carrier element 4 in the depicted design carrying two parallel LED emitters and the two further carrier elements 4' each carrying one LED emitter, wherein the carrier elements 4' are designed to be swivelable independently of each other. The carrier element 4 is here pivotably fastened at the side to the free ends of a U-shaped base body 3 of the carrier frame, held in the drawing by screws 10. Accordingly, a swiveling of the first carrier element 4 and the LED emitters arranged on it can occur here about a swivel axis toward the sports field. The second carrier elements 4' are likewise guided on the first carrier element 4, but have further orientability about two further swivel axes as compared to the swiveling movement of the first carrier element.

This is accomplished by a carrier arm 12 which is attached to the first carrier element at the rear side, or forms a structural unit with it. On this carrier arm 12, carrier bodies 13 are pivoted in a hinged manner in the first joint connection 11, in the depicted design by means of boreholes in the free end of the carrier arm 12 and in the carrier bodies 13, which are joined by means of a connection screw to the first joint connection 11.

Besides this first swivel axis about the carrier arm 12, the two single LED emitters on the second carrier elements 13 comprise a further swivel axis on a second joint connection 8 between the second carrier elements 4' and the carrier body 13, which in the depicted design is offset by 90° with respect to the first joint connection 11. Thus, it is assured that these two single LED emitters have sufficient degrees of freedom in order to be able to direct these at any given point of the sports field to be illuminated.

The carrier elements 4 and 4' have rear boreholes in order to be able to lead wiring of the LED emitters through the cooling element 5.

In FIGS. 2 and 3 it is furthermore noticeable that the LED emitters housing 6 can be installed in various designs in a floodlight lamp. For this, reference numbers 6' and 6" make it clear that the housing 6" is distinctly shorter in its construction. Thus, the installed reflector is also distinctly flatter in its construction and thus has different emission properties than the reflector which is installed in the housing 6'. In this way, different light emissions can be realized in a floodlight lamp by the choice of different designs of emissions LED emitters in regard to reflectors, housing and LED chips, which are furthermore also oriented in different ways, revealing the high degree of variability of these floodlight lamps.

Figure 5:
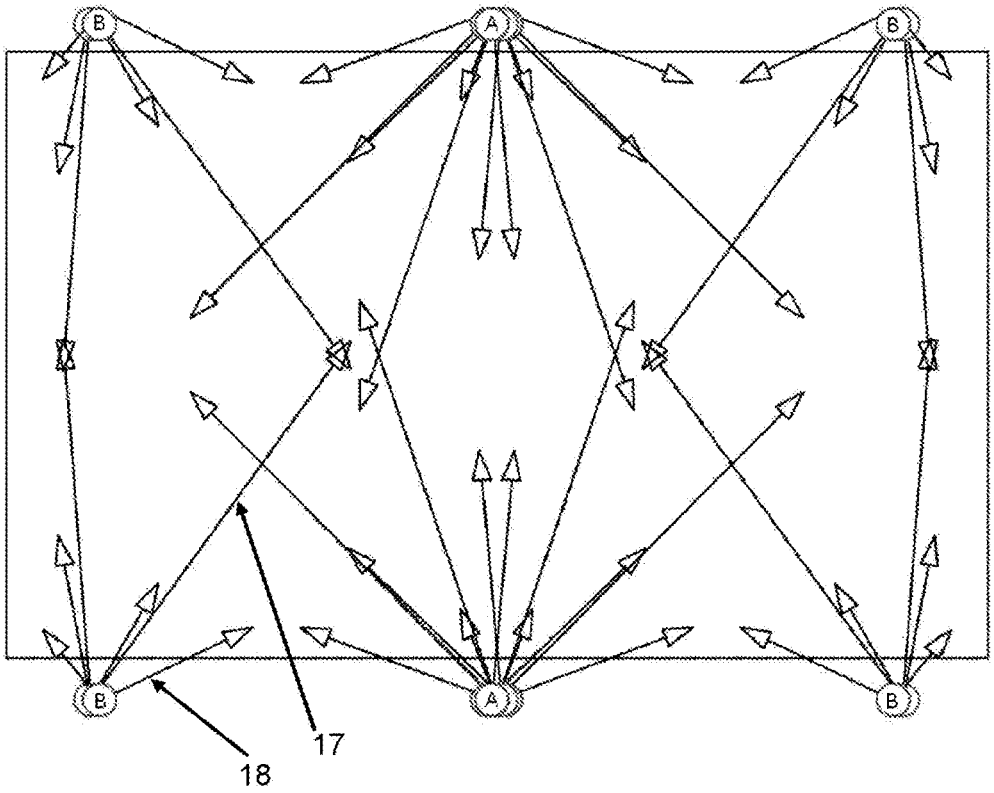

This function is furthermore apparent in the emission diagram of FIG. 5. Here, the arrows coming from the floodlight towers A and B show schematically how the light emission of the floodlight lamps 1 occurs. Shorter arrows 18 and longer arrows 17 are respectively shown here, illustrating that the emission distances of the LED emitters 14 installed in a floodlight lamp are established very differently here. The shorter arrows 18 move in a narrower radius about the respective tower A or B and bring about here the irradiation of the playing field precisely in the problematical side and corner regions of a playing field, which are often very poorly lit in conventional floodlight systems and thus are often under-illuminated, contrary to the proper standards. In at least one embodiment, the LED emitters (14) forming a high-power LED floodlight lamp (1) are controllable individually and/or in pairs in regard to their power as well as the output LED light color by control electronics associated with the respective LED emitter.

FIG. 5 shows here 2 oppositely situated, centrally arranged floodlight towers A and 4 near-corner floodlight towers B. The floodlight towers B arranged in the corners according to this example are outfitted respectively with 2 of the floodlight lamps 1 according to an embodiment of the invention and thus carry a total of 8 LED emitters 14. Of these 8 LED emitters 14, according to an embodiment of the invention every 2 emitter pairs 15 are arranged in parallel and have corresponding reflector housings, making possible an emission over a longer distance by the mutual amplification and a narrower reflector lens.

Since there are 2 such pairs 15 on one floodlight tower B in the corner of the field, there are also 2 long arrows 17 coming from this tower B, which radiate into the center of the playing field and thus illuminate the central field region.

In addition, there are 4 differently oriented short arrows 18, which stand for the lower LED emitter pairs 16 provided with wide emission optics. Therefore, with 2 floodlight lamps 1 used on one floodlight tower B positioned in the corner, there is a total of 4 individual light emission arrows 18 radiating in different directions in the corner of the playing field to be illuminated and thus also effectively illuminating this region in the prescribed manner.

Since the illumination of the playing field with the 6 side towers A and B can be viewed as a kind of mirror image of a half-field, the center towers A are precisely doubled in relation to the corner towers B. That is, 4 of these floodlight lamps 1 according to an embodiment of the invention are arranged on a central tower A, so that 4 long arrows 17 and 8 short arrows 18 are also present in the illumination diagram, coming from a central tower A, which arrows cover in part the central field and in part the side region of the playing field.

This illumination diagram exemplifies the main strength of the floodlight lamp concept according to an embodiment of the invention, since the light emission can be achieved with a very clear number of LED high-power lamps, since these are individualized both in their emission properties and in their orientation to the playing field and thus it is achieved that there is no redundancies of emission in regions where there is basically already an adequate light quality and on the other hand edge regions and regions which are equally important and which are to be treated the same as the center of the field, for example, are not neglected.

The invention claimed is:

1. High-power LED floodlight lamps for arrangement on floodlight towers on lateral sides of a sports field for its illumination, wherein each LED floodlight lamp comprises four LED emitters, which are formed at least from a housing, a cooling element, a reflector lens and a high-power LED chip, the LED emitters are arranged in pairs on a frame having joint connections, an upper LED emitter pair sits on a common carrier element, aligned in parallel, and is provided with a reflector lens which effects a narrow emission angle, whereby the light emission of this LED emitter pair is amplified and equally aligned and thus overcomes further sections in order to reach a center region of the sports field, and while a lower LED emitter pair sits respectively on a separately alignable carrier element and is provided with reflector lenses which effect a wide emission angle, whereby the light emission of this LED emitter pair is alignable separately from each other for targeted illumination of the regions near to the edge of the sports field located closer to the floodlight tower.

2. The high-power LED floodlight lamps as claimed in claim 1, wherein the LED emitters forming the high-power LED floodlight lamp have different powers, housing designs, reflectors, or LED chips.

3. The high-power LED floodlight lamps as claimed in claim 1, wherein the LED emitters forming the high-power LED floodlight lamp are controllable individually in regard to their power as well as the output LED light color by control electronics associated with the respective LED emitter, or the LED emitters forming a high-power LED floodlight lamp are controllable in pairs in regard to their power as well as the output LED light color by the control electronics associated with the respective LED emitter.

4. The high-power LED floodlight lamps as claimed in claim 1, wherein the carrier frame comprises a roughly U-shaped base body, and wherein roughly at the two free ends of the roughly U-shaped base body, the LED emitters are arranged in a swivel-mountable manner on the individual and common carrier elements.

5. The high-power LED floodlight lamps as claimed in claim 1, wherein the two LED emitters forming the upper LED emitter pair are arranged on the common carrier element which is hinged to the U-shaped base body and on which a carrier arm or carrier extension is arranged, on which two further carrier elements are pivotably arranged, on which the LED emitters forming the lower LED emitter pair are likewise pivotably arranged, so that the alignment of these lower LED emitters occurs in two swivel axes.

6. The high-power LED floodlight lamps as claimed in claim 5, wherein at least two carrier bodies are arranged about a common swivel axis pivotable on the carrier arm, wherein the LED emitters are attached to second carrier elements, which are pivotably attached to these carrier bodies about a second swivel axis offset by around 90° from the first swivel axis.

7. The high-power LED floodlight lamps as claimed in claim 1, wherein the upper LED emitter pair, thanks to the housings having reflector lens, has a narrow emission angle between around 7° and 25° for the long distance, and the LED emitters forming the lower LED emitter pair have a wide emission angle for the short distance between around 40° and 60°.

8. A floodlight system for the illumination of sports fields, comprising high-power LED floodlight lamps as claimed in claim 1, wherein the floodlight system is arranged on at least four floodlight towers surrounding the sports field, wherein these four floodlight towers are distributed uniformly at the corners or long edges of the sports field, and at least sixteen LED floodlights lamps each with at least four integrated LED emitters are arranged on crossbeams on the floodlight towers.

9. The floodlight system for the illumination of sports fields, comprising high-power LED floodlight lamps as claimed in claim 8, wherein the floodlight system is arranged on at least six floodlight towers surrounding the sports field, wherein these six floodlight towers are distributed uniformly at the long edges of the sports field, on the four floodlight towers associated with the corners of the sports field there are respectively arranged two LED floodlight lamps each with at least four integrated LED emitters, and on the two floodlight towers arranged centrally at roughly the height of the center line of the sports field on both sides there are respectively arranged four LED floodlight lamps on crossbeams.

* * * * *